United States Patent [19]

Norman

[11] Patent Number: 4,550,453

[45] Date of Patent: Nov. 5, 1985

[54] COMPACT, PORTABLE DRAIN TO EMPTY AND CLEAN A RECREATIONAL VEHICLE HOLDING TANK

[75] Inventor: Howard M. Norman, Sacramento, Calif.

[73] Assignee: Marion E. Norman, Sacramento, Calif. ; a part interest

[21] Appl. No.: 636,968

[22] Filed: Aug. 2, 1984

[51] Int. Cl.[4] ..... E03D 1/00

[52] U.S. Cl. ..... 4/323; 4/321; 134/166 R

[58] Field of Search ..... 4/323, 321, 662; 134/166 R; 137/596; 210/257.1

[56] References Cited

U.S. PATENT DOCUMENTS

| | | | |
|---|---|---|---|
| 1,829,277 | 10/1931 | Haase et al. | 137/596 |
| 2,117,907 | 5/1938 | Ogden | 137/596 |
| 2,499,382 | 3/1950 | Hamer | 137/596 |
| 3,040,333 | 6/1962 | Merrill | 4/323 |
| 3,479,679 | 11/1969 | Vogel | 134/166 R |
| 3,570,503 | 3/1971 | De Boliac | 4/323 |
| 3,760,430 | 9/1973 | Brenden | 4/323 |
| 3,835,478 | 9/1974 | Molus | 4/317 |
| 3,897,599 | 8/1975 | Artzer | 4/323 |
| 4,027,697 | 6/1977 | Bonney | 137/596 |
| 4,222,130 | 9/1980 | Roberts | 4/321 |
| 4,223,702 | 9/1980 | Cook | 4/323 |

*Primary Examiner*—Stephen Marcus
*Assistant Examiner*—Linda J. Sholl
*Attorney, Agent, or Firm*—Morland C. Fischer

[57] ABSTRACT

A compact and portable drain having particular application to recreational vehicles such that sewage contained within a holding tank thereof can be relatively easily and efficiently emptied and disposed of at a sewage dump. The drain is connected between a drain hose and a receptacle at the exterior of the recreational vehicle. The flow of sewage through the drain is controlled by a manually operated, reciprocating valve plate which is positioned to either block or open a flow path through the drain. Thus, the valve plate can be opened so that sewage may be drained from the holding tank to a sewage dump by way of the drain and drain hose. A water inlet is also connected to the drain, so as to permit the holding tank to be flushed and cleaned via the drain once the sewage is removed from the holding tank and the valve plate is closed.

8 Claims, 4 Drawing Figures

COMPACT, PORTABLE DRAIN TO EMPTY AND CLEAN A RECREATIONAL VEHICLE HOLDING TANK

BACKGROUND OF THE INVENTION

1. Field of the Invention

This invention relates to a compact and portable drain having particular application to facilitate a relatively quick and easy disposal of sewage and the subsequent flushing and cleaning of a holding tank from a recreational vehicle. The presently disclosed drain permits such sewage disposal, flushing and cleaning with greater ease and less chance of unsanitary conditions at the interior of the recreational vehicle than that which has heretofor been characteristic of conventional attempts to empty and flush such holding tanks.

2. Prior Art

It has been common for a holding tank in which sewage materials are stored to be emptied and flushed by means of an often inconvenient and unsanitary process. Such a holding tank is common to recreational vehicles, such as a motor home, or the like. Typically, a long and often muddy hose is connected from a source of water to the holding tank at the interior of the recreational vehicle. The water hose frequently enters the recreational vehicle through an opened window, so that mud and dirt might be carried to the recreational vehicle interior. The force of the water at the holding tank is usually sufficient to drain sewage materials therefrom to a sewage dump at sites especially adapted for use by recreational vehicles. The need for such a long and cumbersome water supplying hose by which to flush and clean a recreational vehicle holding tank is highly undesirable.

Reference may be made to U.S. Pat. No. 3,570,503 to Alfred E. DeBoliac which relates to a system for draining waste from a holding tank of an airplane. Unlike the present invention, such a system includes a relatively complex arrangement of dumping and charging valves and is neither compact nor particularly portable and, therefore, is not ideally suitable for interface with a recreational vehicle.

The following U.S. patents are also representative of valving systems used for flushing and cleaning toilets, and the like:

U.S. Pat. No. 3,040,333—William K. Merrill

U.S. Pat. No. 3,835,478—Michael R. Molus

U.S. Pat. No. 4,222,130—George C. Roberts

However, like DeBoliac, above, the last-mentioned patents recite assemblies which are relatively complex and cumbersome and not ideally suitable for the application of draining sewage materials from the holding tank of a recreational vehicle.

SUMMARY OF THE INVENTION

Briefly, and in general terms, the presently disclosed drain comprises a drain body having forward and rearward conduit ends to define a flow path. The forward conduit end is connected to a receptacle at the exterior of the recreational vehicle. The rearward conduit end is connected to a drain hose which communicates with a sewage dump common to recreational vehicle campsites. Extending through the drain body across the flow path is a valve. The valve includes a manually operable, reciprocating valve plate which may be raised or lowered out of or into the flow path of the drain body in order to control the passage of sewage therethrough. A water inlet is also connected to the drain body so that water may be supplied from a suitable source thereof to the holding tank, whereby to flush and clean the tank. With the valve plate moved to the raised position, sewage from the holding tank is emptied through the drain body and drain hose at the sewage dump. With the valve plate moved to the lowered position, water may be supplied through the water inlet for cleaning the tank. By once again moving the valve plate to the raised position, the holding tank may be flushed through the drain body and drain hose, so as to be in a suitable condition to permit further use by the occupants of the recreational vehicle.

DESCRIPTION OF THE PREFERRED EMBODIMENT

Figure 2:
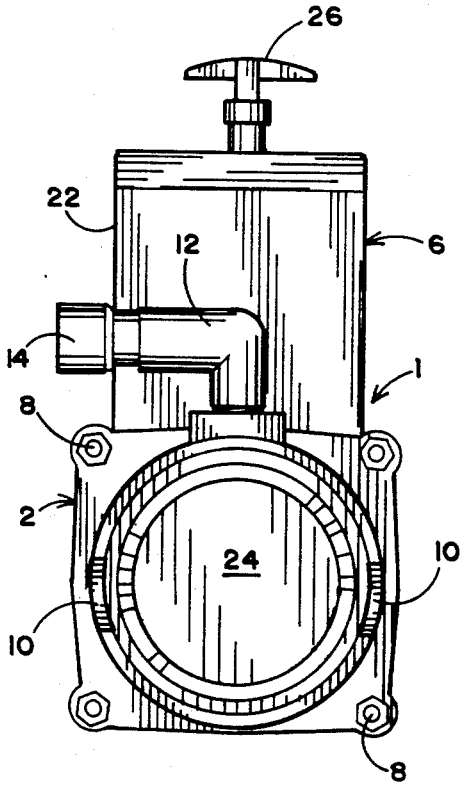
FIG. 2 is an end view taken at the forward conduit end of the drain body.
Figure 3:
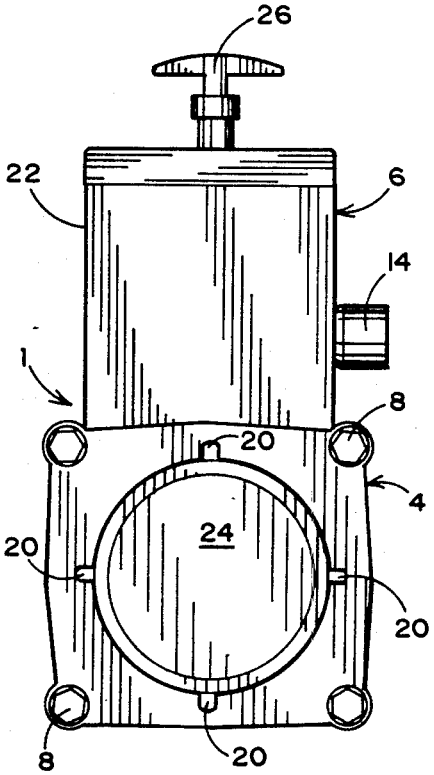
FIG. 3 is an end view taken at the rearward conduit end of the drain body.
Figure 4:
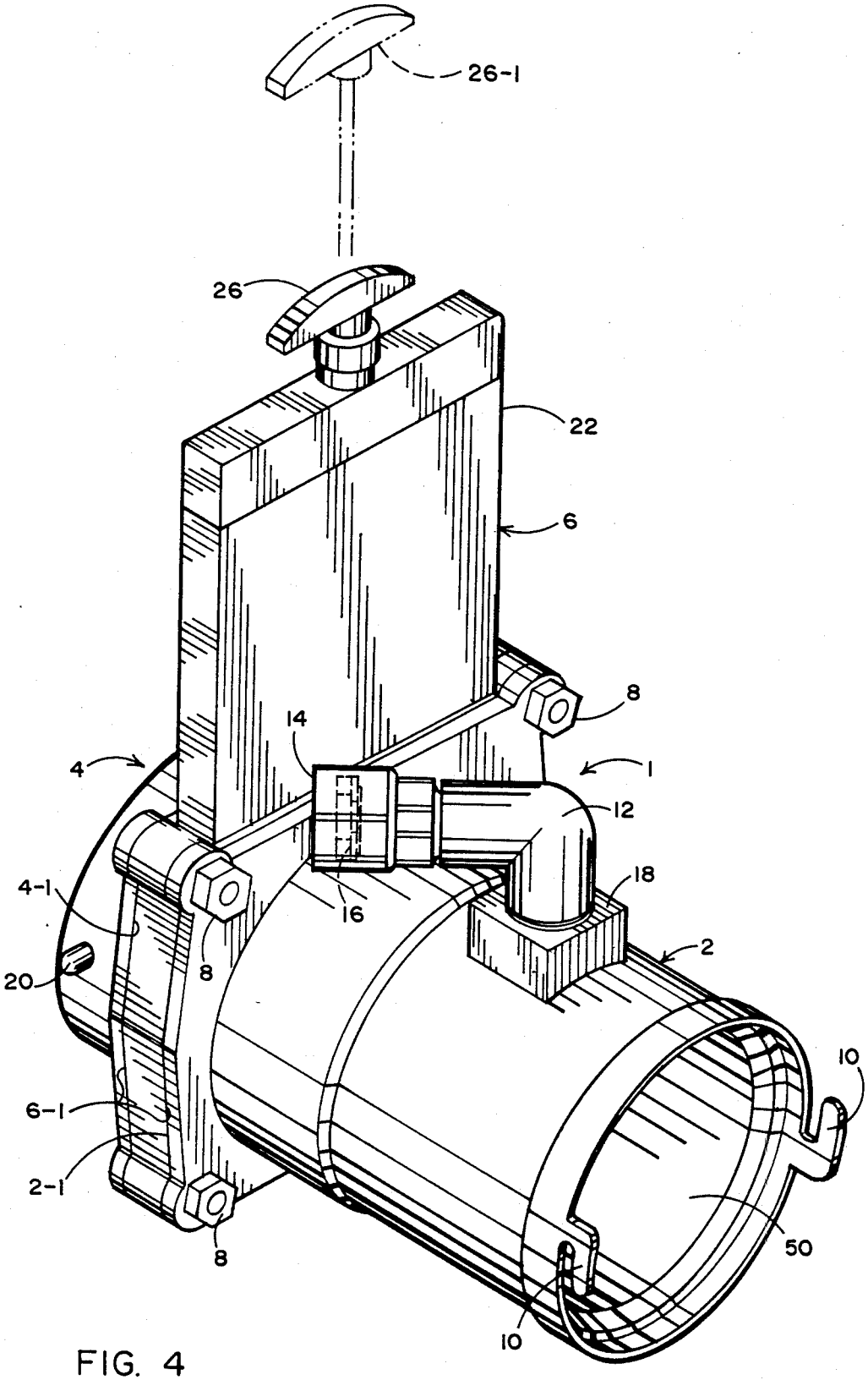
FIG. 4 is an isometric view illustrating the drain which forms the present invention.

The drain which forms the present invention is initially described while referring concurrently to FIGS. 2, 3 and 4 of the drawings. The present drain has particular application to permit a recreational vehicle (e.g. motorhome) holding tank in which sewage is contained to be easily and quickly emptied. The drain body 1 comprises an assembly of three body components: forward and rearward hollow, cylindrical conduit ends 2 and 4, and a valve 6. Drain components 2, 4 and 6 may be molded from a suitable plastic material so as to be characterized by maximized durability and resistance to corrosive materials passing therethrough. The valve 6 is removably connected between conduit ends 2 and 4 by means of a suitable fastener system (e.g. 8). More particularly, and as is best shown in FIG. 4, each of the forward and rearward conduit ends 2 and 4 and valve 6 is constructed to include a planar face, designated 2-1, 4-1, and 6-1, respectively. When in the assembled relationship, the planar faces of conduit ends 2 and 4 and valve 6 are aligned face-to-face one another, so that a cylindrical flow path 50 is defined through the drain body 1. Thus, drain body 1 can be easily and quickly assembled or disassembled for convenient cleaning, repair, or replacement.

Forward conduit end 2 includes a plurality of connector tips 10 coextensively formed therearound. Although a pair of connector tips 10 is shown, drain end 2 may include any other suitable number (e.g. 4) of such tips. Connector tips 10 are appropriately sized to be received by corresponding connectors (not shown) at a receptacle located at the exterior of the recreational vehicle. Thus, by moving the connector tips 10 into mating engagement with the connectors at the recreational vehicle, the forward conduit end 2 of drain body 1 may be removably secured to the recreational vehicle in a manner to permit communication between the holding tank of such vehicle and the drain body, as will be described in greater detail hereinafter.

Extending outwardly from the forward conduit end 2 of drain body 1 (ahead of valve 6) is a water inlet 12.

Water inlet 12 preferably has a screw-type fitting 14 formed at one end thereof so as to be adapted for connection to a conventional hose (best illustrated in FIG. 1), whereby water may be supplied to the interior of drain body 1 from a suitable source thereof. A conventional check valve (shown in phantom and designated 16 in FIG. 4) is located within the fitting 14 to prevent the back flow of sewage through water inlet 12. The second end of water inlet 12 preferably includes screw threads formed therearound by which to removably connect such second end to the forward conduit end 2 of drain body 1. For convenience, the water inlet 12 may be connected to drain body 1 at a raised connector block 18 extending upwardly from forward conduit end 2. Connector block 18 has a threaded aperture extending therethrough by which water inlet 12 may communicate with the interior of drain body 1.

Rearward conduit end 4 includes a suitable plurality of terminal nubs 20 coextensively formed therearound. Terminal nubs 20 are appropriately sized to be received by corresponding connectors formed at the end of a drain hose (best illustrated in FIG. 1). Thus, by moving the terminal nubs 20 into mating engagement with the connectors at the drain hose, the rearward conduit end 4 of drain body 1 may be removably secured to such hose to permit communication through conduit end 4 between the drain hose and the aforementioned holding tank of the recreational vehicle, as will be described in greater detail hereinafter.

Valve 6 includes a valve body 22, a manually operable valve plate 24 (in FIGS. 2 and 3) and a handle 26, which handle is connected through valve body 22 to valve plate 24. Valve plate 24 is adapted for reciprocal movement through valve body 22 so as to control the movement of sewage through drain body 1. That is, in a closed or lowered position, the valve plate 24 is positioned at the interior of drain body 1 so as to extend across the flow path 50, whereby to block the movement of sewage past valve plate 24. In an opened position, the valve handle 26 is manually raised (shown in phantom and designated 26-1 in FIG. 4) so as to cause a corresponding movement of valve plate 24 to a raised position out of the interior of valve body 1, so as to permit the movement of sewage through flow path 50 and past valve plate 24. Thus, raising and lowering the valve plate 24 through valve body 22 by means of handle 26 will permit the user to control the movement of sewage through the flow path 50 of drain body 1.

Figure 1:
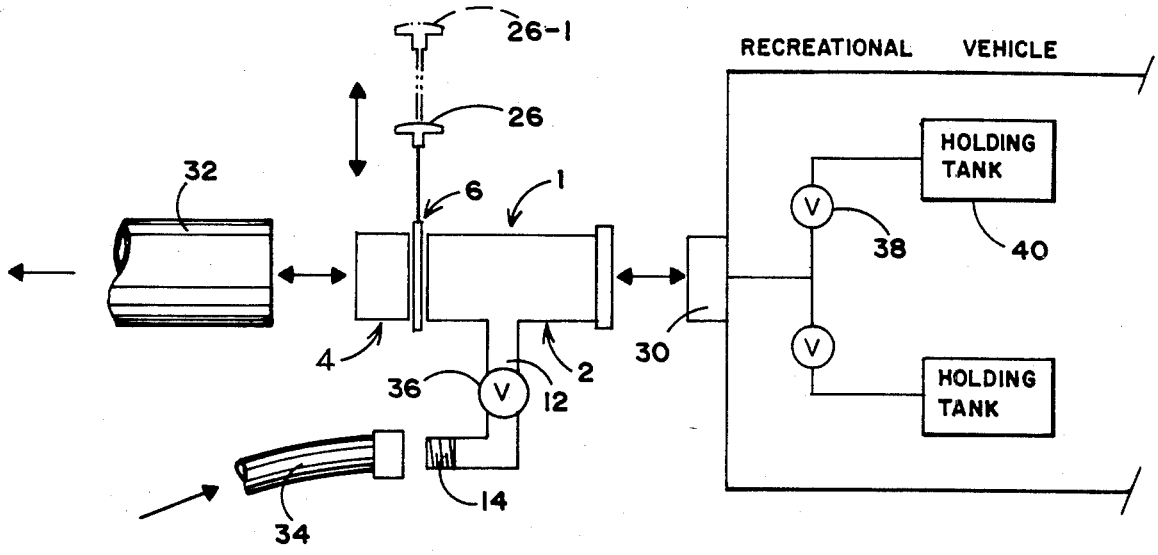
FIG. 1 is a schematic diagram showing the interconnection of the presently disclosed drain for emptying a holding tank of a recreational vehicle.

The operation of the presently disclosed drain is now disclosed while referring to FIG. 1 of the drawings. As previously disclosed, the connector tips 10 at the forward conduit end 2 of drain body 1 are moved into mating engagement with corresponding connectors formed at a receptacle 30 at the exterior of the recreational vehicle. The terminal nubs 20 at the rearward conduit end 4 of the drain body 1 are moved into mating engagement with corresponding connectors formed at one end of a flexible drain hose 32. The other end of drain hose 32 is interfaced with a sewage dump, such as that typically found at recreational vehicle campsites. The screw-type fitting 14 of water inlet 12 is connected to a corresponding fitting formed at one end of a flexible hose 34. The other end of hose 34 is connected to a source of water, also typically found at recreational vehicle campsites.

Initially, no water is permitted to flow from the source thereof through water inlet 12 via hose 34. This may be accomplished by means of a valve (not shown) at the water source. In the alternative, the water inlet 12 may have a valve 36 incorporated therewithin. This valve 36 may be opened or closed to control the passage of water through inlet 12. Valve 36 is initially closed. The reciprocating valve plate (24 of FIGS. 2 and 3) is then moved to the opened position. That is, and as previously disclosed, raising handle 26 (to the position 26-1 shown in phantom) causes a corresponding movement of the valve plate out of the interior of drain body 1. Thus, the flow path 50 of drain body 1 is conditioned to receive the passage of sewage therethrough. A valve 38, associated with a recreational vehicle holding tank 40 in which sewage material is contained, is opened at the interior of the recreational vehicle. Thus, the contents of holding tank 40 can be emptied under the influence of gravity and disposed of at the sewage dump at the recreational vehicle campsite by way of valve 38, the flow path 50 through forward and rearward conduit ends 2 and 4, opened valve 6 and drain hose 32.

Once the holding tank 40 has been suitably emptied, the reciprocating valve plate (24) is moved to the closed position by lowering handle 26, whereby to cause the valve plate to move into the interior of drain body 1 and across the flow path 50 extending therethrough. Thus, moving the valve plate to the closed position prevents communication between holding tank 40 and drain hose 32 by way of drain body 1. The valve 36 associated with water inlet 12 is then opened so that water can be supplied from the source thereof to the sewage holding tank 40 by way of water hose 34, the forward conduit end 2 of drain body 1, and valve 38. Thus, the previously emptied holding tank 40 is filled with water, such that holding tank 40 may be flushed and cleaned.

After holding tank 40 is filled with water, the valve 36 associated with water inlet 12 is again closed. The reciprocating valve plate (24 in FIGS. 2 and 3) is once again moved to the opened position by raising handle 26 to the position shown in phantom and represented by 26-1. The water which has filled holding tank 40 is disposed of at the sewage dump by way of drain hose 32 and the flow path 50 through the interior of drain body 1. The process by which holding tank 40 is filled and emptied, as just described, may be completed one or more times to assure a proper flushing and cleaning of the holding tank. Upon completion of the flushing and cleaning process, the holding tank valve 38 is closed, and the drain body 1 is disconnected from between the drain hose 32 and the receptacle 30 at the exterior of the recreational vehicle. Holding tank 40 is now in a ready condition to permit further use by occupants of the recreational vehicle.

Accordingly, the presently disclosed drain has a compact and portable configuration, whereby to provide a relatively quick and easy means by which the holding tank of a recreational vehicle may be emptied, flushed, and cleaned without the inconvenience and possible unsanitary conditions that have been undesirably characteristic of conventional attempts to empty and clean such holding tank.

It will be apparent that while a preferred embodiment of the invention has been shown and described, various modifications and changes may be made without departing from the true spirit and scope of the invention.

Having thus set forth a preferred embodiment of the present invention, what is claimed is:

1. A drain to be interfaced with a recreational vehicle to permit the contents of a holding tank from said vehicle to be emptied, said drain comprising:

a hollow drain body defining a flow path communicating with the holding tank and through which the contents of said tank can pass, flow control means to control the passage of the contents through the flow path of said drain body, means by which to enable said flow control means to be moved to a first position at the interior of said drain body and across the flow path to block the passage of the holding tank contents therethrough or to a second position at the exterior of said drain body and out of said flow path to permit the passage of the holding tank contents therethrough, and a fluid inlet communicating with said flow path for supplying to the holding tank a fluid for cleaning said tank after the contents thereof have been emptied, said fluid inlet interconnected at one end thereof with said drain body ahead of said flow control means and closer to the recreational vehicle than said control means, and said fluid inlet interconnected at another end thereof with a source of said fluid, said fluid inlet supplying fluid to said holding tank by way of said drain body only when said flow control means is moved to the first position across said flow path.

2. The drain recited in claim 1, wherein said drain body has forward and rearward conduit ends, said forward conduit end including a first set of connectors by which to removably connect said conduit end to the recreational vehicle.

3. The drain recited in claim 2, wherein said rearward conduit end includes a second set of connectors by which to removably connect said conduit end to a drain hose through which the contents of the holding tank may pass, such that said drain body is removably connected between the recreational vehicle and the drain hose.

4. The drain recited in claim 1, wherein said flow control means to control the passage of the contents from the holding tank through said flow path is a valve plate.

5. A drain recited in claim 1, wherein said fluid inlet includes a check valve to prevent the backflow of material therethrough.

6. The drain body recited in claim 1, wherein said fluid inlet is connected between said flow path and a water hose, so that water can be supplied through said drain body as the fluid for cleaning the holding tank.

7. The drain recited in claim 1, wherein the means to enable the movement of said flow control means to said first or second positions includes a handle attached to said control means.

8. The drain recited in claim 1, wherein the means to enable the movement of said flow control means to said first or second positions includes a guide body extending between the interior and exterior of said drain body, said guide body cooperating with said flow control means to permit the reciprocal movement thereof between said first and second positions.

* * * * *